US008967748B2

(12) United States Patent
Fujisawa et al.

(10) Patent No.: US 8,967,748 B2
(45) Date of Patent: Mar. 3, 2015

(54) PRINTING DEVICE AND PRINTING METHOD

(71) Applicant: Seiko Epson Corporation, Tokyo (JP)

(72) Inventors: Kazutoshi Fujisawa, Okaya (JP); Mitsuaki Yoshizawa, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/910,978

(22) Filed: Jun. 5, 2013

(65) Prior Publication Data

US 2013/0265356 A1 Oct. 10, 2013

Related U.S. Application Data

(63) Continuation of application No. 12/841,364, filed on Jul. 22, 2010, now Pat. No. 8,480,195.

(30) Foreign Application Priority Data

Jul. 24, 2009 (JP) ..... 2009-173598

(51) Int. Cl.

| | |
|---|---|
| ***B41J 29/38*** | (2006.01) |
| ***B41J 2/015*** | (2006.01) |
| ***B41J 2/14*** | (2006.01) |
| ***B41J 2/045*** | (2006.01) |
| ***B41J 2/21*** | (2006.01) |
| ***B41J 2/505*** | (2006.01) |
| ***B41J 11/00*** | (2006.01) |

(52) U.S. Cl.

CPC ..... *B41J 2/04501* (2013.01); *B41J 2/2114* (2013.01); *B41J 2/5056* (2013.01); *B41J 11/002* (2013.01)

USPC ..... 347/9; 347/20; 347/47

(58) Field of Classification Search

USPC ..... 347/8–9, 102, 43–47, 20

See application file for complete search history.

(56) References Cited

U.S. PATENT DOCUMENTS

| | | | | |
|---|---|---|---|---|
| 7,407,277 | B2 | 8/2008 | Yoneyama | |
| 7,562,957 | B2 | 7/2009 | Mills et al. | |
| 2002/0154182 | A1 * | 10/2002 | Takahashi et al. | 347/12 |
| 2005/0093952 | A1 | 5/2005 | Hoshino | |
| 2005/0128234 | A1 * | 6/2005 | Yokozawa | 347/12 |

(Continued)

FOREIGN PATENT DOCUMENTS

| | | | |
|---|---|---|---|
| JP | 2001-239660 | | 9/2001 |
| JP | 2001-253096 | | 9/2001 |
| JP | 2001239660 | A * | 9/2001 |
| JP | 2002-307672 | | 10/2002 |

(Continued)

*Primary Examiner* — Jason Uhlenhake

(74) *Attorney, Agent, or Firm* — Workman Nydegger

(57) ABSTRACT

A printing device that forms a background by a first ink and images on the background by a second ink includes a head having first and second nozzle lines that eject, respectively, the first and second inks. The inks are ejected as the head moves, with respect to a medium, in a main scanning direction intersecting the first and second nozzle lines. A transport section transports the medium in a sub-scanning direction along the first and second nozzle lines. In an ejecting operation, the first and second inks are ejected in the relative movement in the main scanning direction and the relative transportation in the sub-scanning direction is performed. In the sub-scanning direction, first and second nozzle line used areas are set where the first and second inks, respectively, are ejected from the first and second nozzle lines. A nozzle unused area is defined therebetween.

7 Claims, 11 Drawing Sheets

(56) References Cited

U.S. PATENT DOCUMENTS

| | | | | |
|---|---|---|---|---|
| 2006/0077404 | A1 | 4/2006 | Usui | |
| 2007/0279470 | A1 | 12/2007 | Arai | |
| 2009/0021541 | A1 * | 1/2009 | Rueby | 347/5 |

FOREIGN PATENT DOCUMENTS

| | | |
|---|---|---|
| JP | 2003-285422 | 10/2003 |
| JP | 2005-144749 | 6/2005 |
| JP | 2009-056695 | 3/2009 |

* cited by examiner

PRINTING DEVICE AND PRINTING METHOD

This application is a Continuation of application Ser. No. 12/841,364, filed Jul. 22, 2010, and is expressly incorporated herein by reference. The entire disclosure of Japanese Patent Application No. 2009-173598, filed Jul. 24, 2009 is expressly incorporated by reference herein.

BACKGROUND

1. Technical Field

The present invention relates to a printing device and a printing method.

2. Related Art

There have been known ink jet type printing devices which perform a printing by ejecting ink on a medium. Among them, a printing device has been disclosed which first prints background images and then prints actual images upon the background images. JP-A-2001-239660, which is an example of related art, discloses a printing device in which topcoat nozzles (white) 312 and color nozzles 21 are disposed spaced apart from each other in the transport direction. JP-A-2003-285422, which is another example of the related art, discloses a printing device provided with heads for actual images and heads for background images.

There may be a case where images are formed so immediately after the formation of the background that the images are formed in the state where ink used for the background has not yet dried. This causes the ink for the background and ink for the images to be mixed with each other and the image quality of the formed images to be deteriorated.

SUMMARY

An advantage of some aspects of the invention is to suppress the deterioration of an image quality due to mixing of ink used to form a background and ink used to form images.

According to an aspect of the invention, there is provided a printing device which forms a background by a first ink and forms images on the background by a second ink, including: (A) a head configured to have a first nozzle line which ejects the first ink and a second nozzle line which ejects the second ink, and to eject the first and second inks while relatively moving in a main scanning direction intersecting the first nozzle line and the second nozzle line, with respect to a medium; (B) a transport section configured to relatively transport the medium in a sub-scanning direction along the first nozzle line and the second nozzle line with respect to the head; and (C) a controller configured to control the head and the transport section such that an ejecting operation where the first ink and the second ink are ejected in the relative movement in the main scanning direction and the relative transportation in the sub-scanning direction are repeatedly performed, wherein, in the sub-scanning direction, a first nozzle line used area is set where the first ink is ejected from the first nozzle line and a second nozzle line used area where the second ink is ejected from the second nozzle line is set, and wherein the controller controls the head such that a nozzle unused area where neither the nozzles in the first nozzle line or the nozzles in the second nozzle line are used is formed between the first nozzle line used area and the second nozzle line used area.

Other features of the invention will be shown throughout the specification and the accompanying drawings.

DESCRIPTION OF EXEMPLARY EMBODIMENTS

Figure 1:
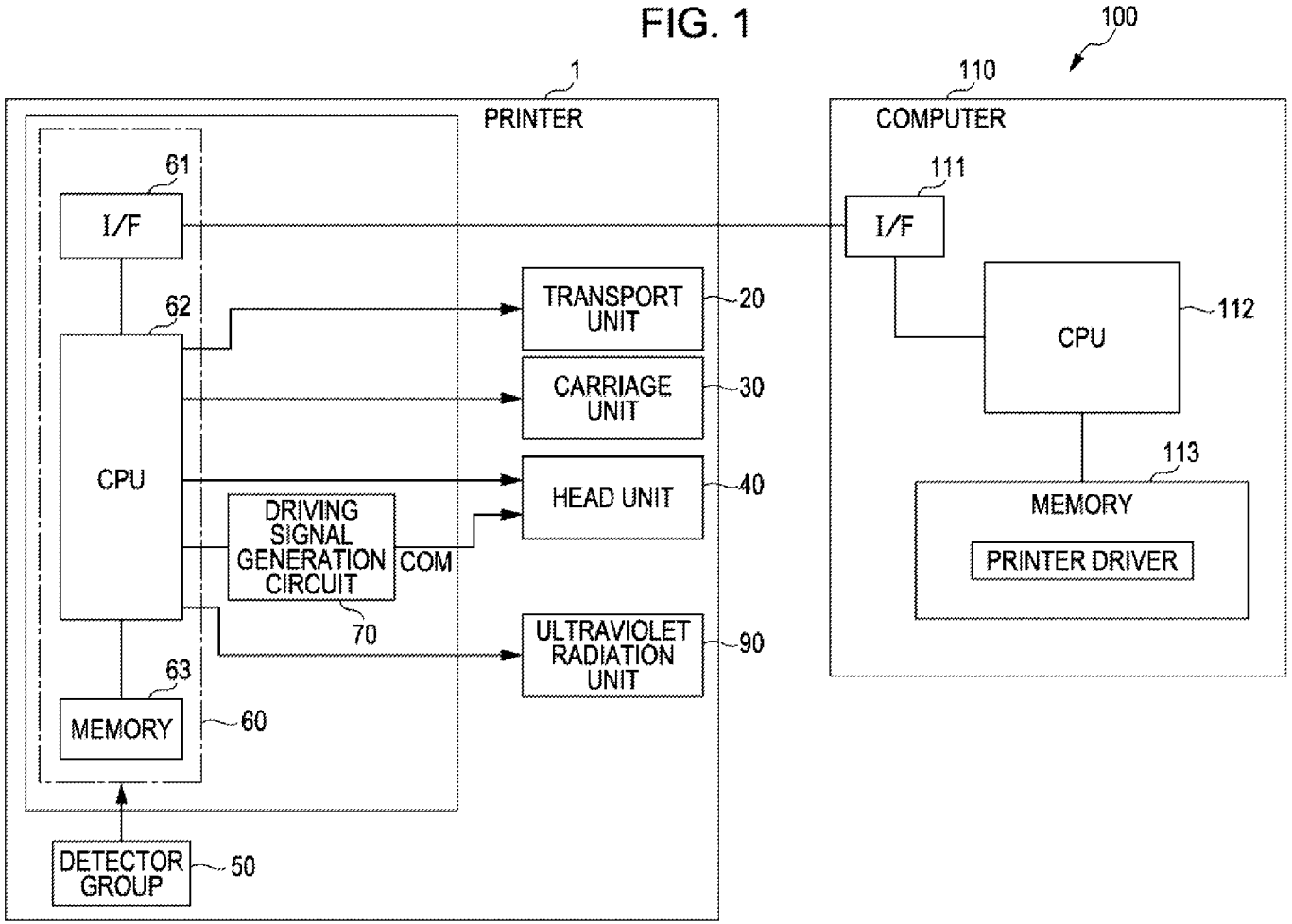
FIG. 1 is a block diagram illustrating a configuration of a printing system.

The following points become apparent by the description of this specification and the accompanying drawings.

According to an aspect of the invention, there is provided a printing device which forms a background by a first ink and forms images on the background by a second ink, including a head configured to have a first nozzle line which ejects the first ink and a second nozzle line which ejects the second ink, and to eject the first and second inks while it is relatively moved in a main scanning direction intersecting the first nozzle line and the second nozzle line, with respect to a medium, a transport section configured to relatively transport the medium in a sub-scanning direction along the first nozzle line and the second nozzle line with respect to the head, and a controller configured to control the head and the transport section such that an ejecting operation where the first ink and the second ink are ejected in the relative movement in the main scanning direction and the relative transportation in the sub-scanning direction are repeatedly performed, wherein, in the sub-scanning direction, a first nozzle line used area where the first ink is ejected from the first nozzle line and a second nozzle line used area where the second ink is ejected from the second nozzle line is set, and wherein the controller controls the head such that a nozzle unused area where neither the nozzles in the first nozzle line or the nozzles in the second nozzle line are used is formed between the first nozzle line used area and the second nozzle line used area.

In this way, it takes more time until the image is formed after the dots of the background are formed, and thus it is possible to suppress the deterioration of an image quality due to the mixing of the ink used to form the background and the ink used to form the images.

In this printing device, it is preferable that each nozzle in the first nozzle line and the second nozzle line is provided with a driving element used to eject the ink, and dots of the background are formed by applying a first driving signal including a plurality of driving pulses with the same form to the driving elements of the nozzles in the first nozzle line, and dots of the images are formed by applying a second driving signal including a plurality of driving pulses with different forms to the driving elements of the nozzles in the second nozzle line. Also, it is preferable that a generation cycle of the first driving signal is the same as that of the second driving signal. Also, the printing device further includes a radiation device configured to radiate light for promoting curing of the first ink and the second ink in the medium, wherein it is preferable that on a dot image formed by the first ink and on a dot image formed by the second ink, the radiation intensities are different from each other. Further, it is preferable that when dots are formed by ejecting the second ink from the nozzles in the second nozzle line, the dots are formed to be smaller than the dots formed by the first ink.

It is preferable that a resolution of the background formed by the first ink is lower than that of the images formed by the second ink. Also, it is preferable that the first nozzle line used area is broader than the second nozzle line used area.

In this way, it takes more time until the image is formed after the dots of the background are formed, and thus it is possible to suppress the deterioration of an image quality due to the mixing of the ink used to form the background and the ink used to form the images.

According to an aspect of the invention, there is provided a printing method in which a background is formed by first ink ejected from a first nozzle line and images are formed on the background by second ink ejected from a second nozzle line, by ejecting the first ink and the second ink while moving in a main scanning direction intersecting the first nozzle line and the second nozzle line with respect to a medium, the method including setting, in a sub-scanning direction intersecting the main scanning direction, a first nozzle line used area where the first ink is ejected from the first nozzle line and a second nozzle line used area where the second ink is ejected from the second nozzle line; setting the first nozzle line and the second nozzle line such that a nozzle unused area where neither nozzles in the first nozzle line or nozzles in the second nozzle line are used is formed between the first nozzle line used area and the second nozzle line used area, and ejecting the first ink from the first nozzle line and the second ink from the second nozzle ink.

In this way, it takes more time until the image is formed after the dots of the background are formed, and thus it is possible to suppress the deterioration of the image quality due to the mixing of the ink used to form the background and the ink used to form the images.

Embodiments

Printing System

FIG. 1 is a block diagram illustrating a configuration of a printing system 100. The printing system 100 according to this embodiment is a system including a printer 1 and a computer 110, as shown in FIG. 1.

The printer 1 is a printing device which forms (prints) images on a medium by ejecting ink on the medium, which is a serial type color ink eject printer in this embodiment. The printer 1 can print images on various kinds of media such as a film sheet 0 or the like. A configuration of the printer 1 will be described later.

The computer 110 includes an interface 111, a CPU 112, and a memory 113. The interface 111 exchanges data with the printer 1. The CPU 112 executes various kinds of programs installed in the computer 110 by entirely controlling the computer 110. The memory 113 stores various kinds of programs or various kinds of data. Among the programs installed in the computer 110, there is a printer driver which converts image data output from application programs into printing data. The computer 110 outputs the printing data generated by the printer driver to the printer 1.

Configuration of the Printer

Figure 2A:
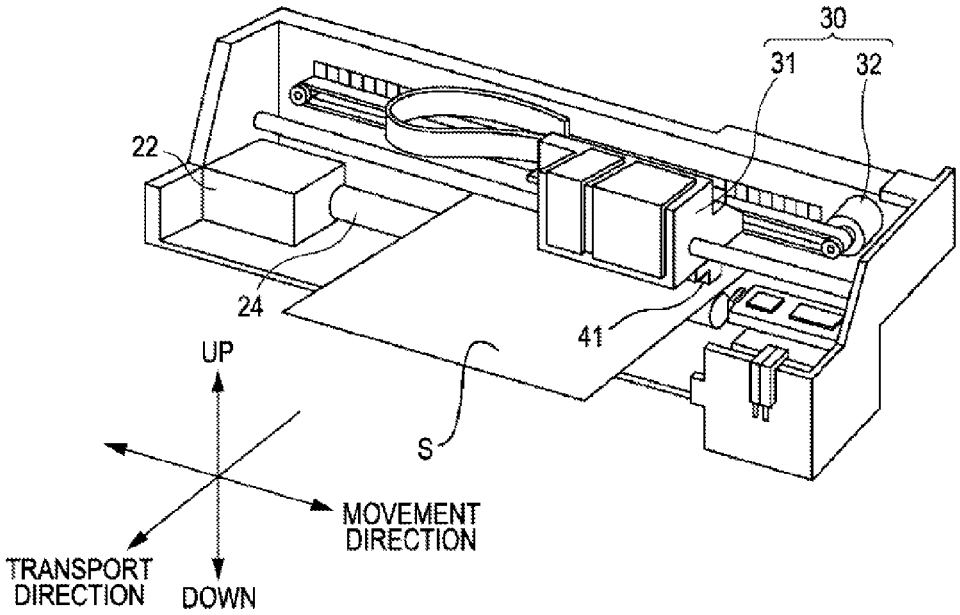
FIG. 2A is a schematic diagram illustrating an entire configuration of a printer.
Figure 2B:
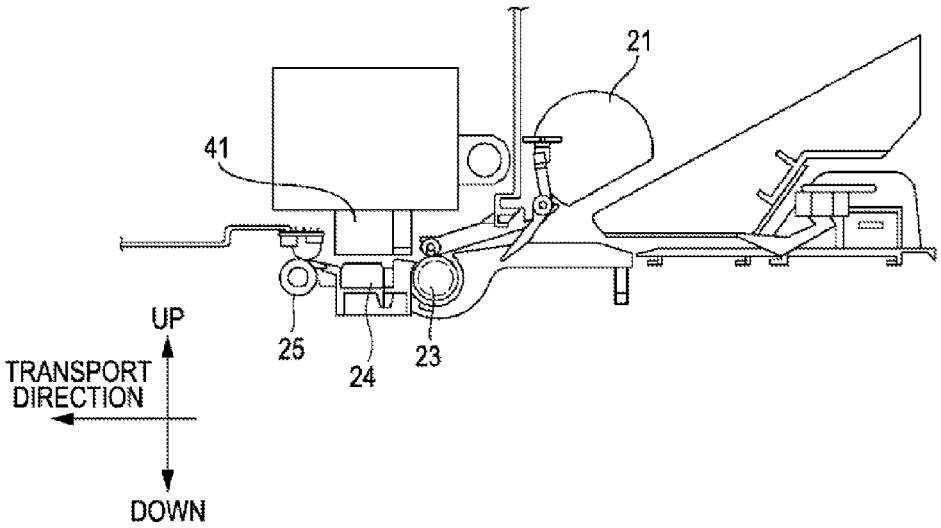
FIG. 2B is a transverse sectional view illustrating the entire configuration of the printer.

FIG. 2A is a schematic diagram of an entire configuration of the printer 1. FIG. 2B is a transverse sectional view of the entire configuration of the printer 1.

The printer 1 includes a transport unit 20, a carriage unit 30, a head unit 40, a detector group 50, a controller 60, a driving signal generation circuit 70, and an ultraviolet radiation unit 90.

In the printer 1, the controller 60 controls the respective units (the transport unit 20, the carriage unit 30, the head unit 40, the driving signal generation circuit 70 and the ultraviolet radiation unit 90). The controller 60 controls the respective units based on printing data sent from the computer 110 and prints images on a medium such as a film sheet 0 or the like. Here, the film sheet 0 used in this embodiment is a sheet where the opposite side can be viewed through the film. In addition, the used medium may be a transparent medium or the like such as the film sheet 0, or may be paper or the like with no transparency.

The transport unit 20 transports the film sheet 0 in a predetermined direction (hereinafter, referred to as a "transport direction"). The transport unit 20 includes a paper feed roller 21, a transport motor 22, a transport roller 23, a platen 24, and a paper discharge roller 25. The paper feed roller 21 is a roller which feeds the film sheet 0, which is inserted into a medium inserting entrance, into the printer. The transport roller 23 is a roller which transports to a printable area the film sheet 0 fed by the paper feed roller 21, and is driven by the transport motor 22. The platen 24 supports the film sheet 0 in the course of the printing. The paper discharge roller 25 is a roller which discharges the film sheet 0 to the outside of the printer, and is provided downstream in the transport direction with regards to the printable area. The paper discharge roller 25 rotates in synchronization with the transport roller 23.

The carriage unit 30 moves a head in a predetermined direction (movement direction in the figure). The carriage unit 30 includes a carriage 31 and a carriage motor 32. The carriage 31 can be moved reciprocally in the movement direction, and is driven by the carriage motor 32. The carriage 31 supports an ink cartridge containing ink in an attachable and detachable manner.

The head unit 40 ejects ink on the film sheet. The head unit 40 has a head 41 provided with a plurality of nozzles. The head 41 is provided in the carriage 31 as the head unit 40, and thus when the carriage 31 is moved in the movement direction, the head 41 is also moved in the movement direction. The head 41 intermittently ejects ink in the course of the movement in the movement direction, and thereby dot lines along the movement direction are formed on the film sheet 0. In this embodiment, the ink ejected from the head 41 is an ultraviolet cured ink. An internal structure of the head will be described later.

The detector group 50 means various detectors which detect information for the respective units of the printer 1 and send it to the controller 60.

The controller 60 is a control unit which controls the printer. The controller 60 includes an interface section 61, a CPU 62, and a memory 63. The interface section 61 performs transmission and reception of data between the computer 110 which is an external device and the printer 1. The CPU 62 is an operational processing device which performs overall control of the printer. A memory 63 is an area for storing programs of the CPU 62 or is for securing a working area, and includes storage devices such as RAM, EEPROM or the like.

The CPU 62 controls the respective units according to the programs stored in the memory 63.

The driving signal generation circuit 70 generates driving signals which are applied to a driving element such as a piezoelectric element or the like included in the head described later, so as to eject ink drops. The driving signal generation circuit 70 includes a DAC (not shown) and generates analog voltage signals based on digital data concerning waveforms of the driving signals sent from the controller 60. In addition, the driving signal generation circuit 70, which includes an amplifying circuit (not shown), performs the power amplification for the generated voltage signals and generates the driving signals. The driving signal generation circuit 70 in this embodiment includes two driving signal generation circuits, the one driving signal generation circuit generates a driving signal for ejecting a white ink, and the other driving signal generation circuit generates a driving signal for ejecting a color ink. These two driving signals are generated at the same time.

The ultraviolet radiation unit 90 is a device which radiates ultraviolet rays so as to cure the above-described ultraviolet cured ink. In this embodiment, the ultraviolet radiation unit 90 is constituted by an LED or the like, and is provided in the head 41. When the carriage unit 30 moves the head 41, the ultraviolet radiation unit 90 is also moved in the movement direction of the head 41. An ultraviolet radiation intensity of the ultraviolet radiation unit 90 is controlled by the controller 60.

Figure 3:
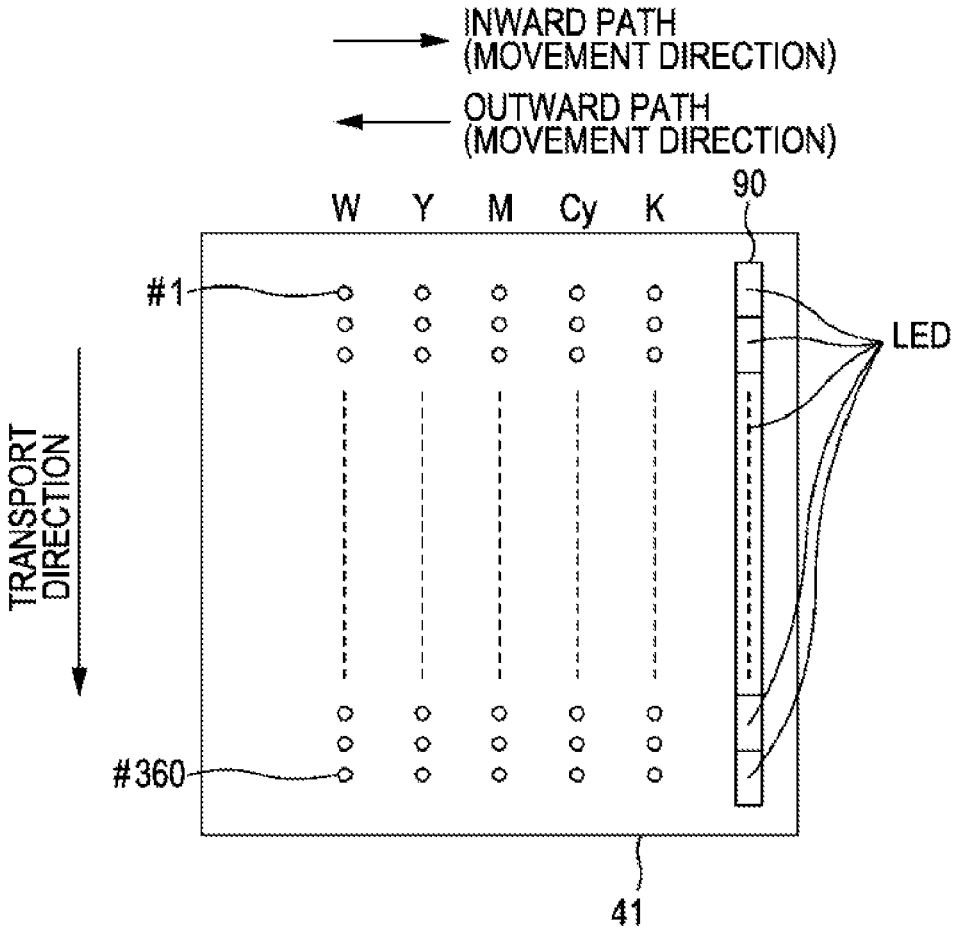
FIG. 3 is a diagram illustrating nozzle arrangement in a head of a head unit.

FIG. 3 is a diagram illustrating a nozzle arrangement in the head 41 of the head unit 40. In addition, here, the nozzle lines can be seen only from the bottom, and thus, for convenience of the description, are illustrated so as to be seen from the top.

The head 41 is provided with a black ink nozzle line K, a cyan ink nozzle line Cy, a magenta ink nozzle line M, a yellow ink nozzle line Y, and a white ink nozzle line W. Each of the nozzle lines includes a number of nozzles (herein, 360) for ejecting ink. A number of nozzles in each nozzle line are arranged at a constant nozzle pitch (herein, 360 dpi) along the transport direction of the film sheet 0.

In addition, the head 41 is equipped with the ultraviolet radiation unit 90 which cures the ultraviolet cured ink. The ultraviolet radiation unit 90 is constituted by arranging a plurality of LEDs for radiating ultraviolet rays in a sub-scanning direction. The output of each LED can be adjusted, and the illumination intensity thereof can be made different for each region in the sub-scanning direction.

In this embodiment, the ink is ejected in the outward path where the head is moved. Thereby, the landing ink is cured by the ultraviolet radiation unit 90 immediately after the ink lands onto the medium.

Figure 4:
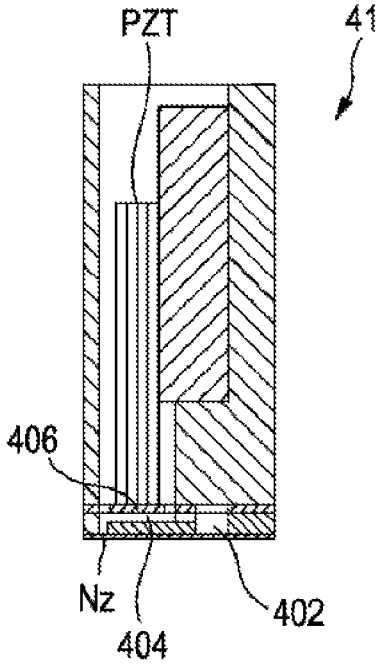
FIG. 4 is a diagram illustrating a structure of the head.

FIG. 4 is a diagram illustrating a configuration of the head 41. In the figure, there are shown a nozzle Nz, a piezoelectric element PZT, an ink supply path 402, a nozzle communication path 404, and an elastic plate 406.

The ink supply path 402 is supplied with ink from an ink tank (not shown). The ink or the like is supplied for the nozzle communication path 404. The piezoelectric element PZT is applied with driving pulses of driving signals described later. When applied with the driving pulses, the piezoelectric element PZT is elongated and contracted in response to the signals of the driving pulses, thereby vibrating the elastic plate 406. Ink drops with an amount corresponding to the amplitude of the driving pulses are ejected from the nozzle Nz.

Figure 5:
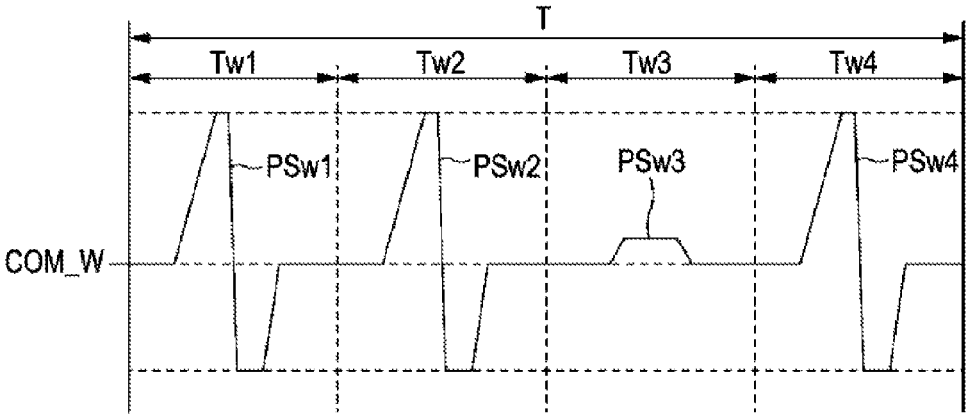
FIG. 5 is a diagram illustrating a white driving signal.

FIG. 5 is a diagram illustrating a white driving signal COM_W. The driving signal COM_W is repeatedly generated every repetition cycle T. The period T which is the repetition cycle corresponds to a period when the head 41 is moved on the film sheet 0 in an amount of one pixel.

The driving signal COM_W includes a driving pulse PSw1 generated at the duration Tw1 in the repetition cycle T, a driving pulse PSw2 generated at a duration Tw2 therein, a minute vibration pulse PSw3 generated at a duration Tw3 therein, and a driving pulse PSw4 generated at a duration Tw4 therein. By applying the driving pulses PSw1, PSw2 and PSw4 or the minute vibration pulse PSw3 at the respective durations included in the period T to the piezoelectric element PZT, based on pixel data included in printing data, a dot may be formed or not formed within a single pixel.

When a small dot is formed in a single pixel, the driving pulse PSw2 at the duration Tw2 is applied to the piezoelectric element PZT to eject one ink drop. When a medium dot is formed in a single pixel, the driving pulse PSw1 at the duration Tw1 and the driving pulse PSw4 at the duration Tw4 are applied to the piezoelectric element PZT to eject two ink drops. When a large dot is formed in a single pixel, the driving pulse PSw1 at the duration Tw1, the driving pulse PSw2 at the duration Tw2, and the driving pulse PSw4 at the duration Tw4 are applied to the piezoelectric element PZT to eject three ink drops. When a dot is not formed in a single pixel, the minute vibration pulse PSw3 at the duration Tw3 is applied to the piezoelectric element PZT not to eject ink drops.

As such, the number of the driving pulses applied can alter the size of the dot. Further, the amplitudes of the driving pulses can be appropriately adjusted depending on the amount of ink ejected.

Figure 6:
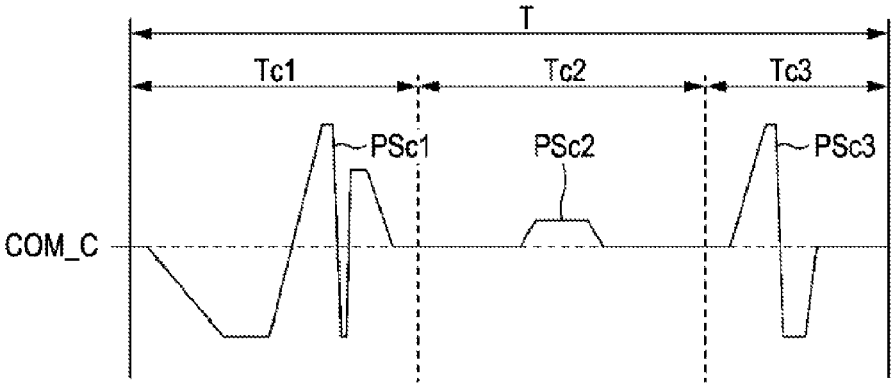
FIG. 6 is a diagram illustrating a color driving signal.

FIG. 6 is a diagram illustrating a color driving signal COM_C. The driving signal COM_C is also repeatedly generated every repetition cycle T the same as the above-described driving signal COM_W.

The driving signal COM_C includes a driving pulse PSc1 generated at a duration Tc1 in the repetition cycle, a minute vibration pulse PSc2 generated at a duration Tc2 therein, and a driving pulse PSc3 generated at a duration Tc3 therein. By applying the driving pulses PSc1 and PSc3 and the minute vibration pulse PSc2 at the respective durations included in the period T to the piezoelectric element PZT, based on pixel data included in printing data, a dot may be formed or not formed within a single pixel.

When a small dot is formed in a single pixel, the driving pulse PSc1 at the duration Tc1 is applied to the piezoelectric element PZT to eject one small ink drop. When a medium dot is formed in a single pixel, the driving pulse PSc3 at the duration Tc3 is applied to the piezoelectric element PZT to eject one ink drop that is larger compared with when the driving pulse PSc1 is applied. When a large dot is formed in a single pixel, the driving pulse PSc1 at the duration Tc1 and the driving pulse PSc3 at the duration Tc3 are applied to the piezoelectric element PZT to eject two ink drops. When a dot is not formed in a single pixel, the minute vibration pulse PSc2 at the duration Tc2 is applied to the piezoelectric element PZT not to eject ink drops.

By using the driving pulses which are generated with different forms depending on the dot size, it is possible to perform a higher resolution printing. For this reason, when a background image is formed, the driving pulses with the same form can be applied to a plurality of piezoelectric elements PZT to generate a large dot, and when a color image is formed, the driving pulses with a number of forms can be applied to the piezoelectric element PZT, thereby printing the color image with a higher resolution than the background image.

In addition, the two driving signals shown here form the color dots with a higher resolution than the white dots, but this is only an example, the invention is not limited thereto.

Figure 7:
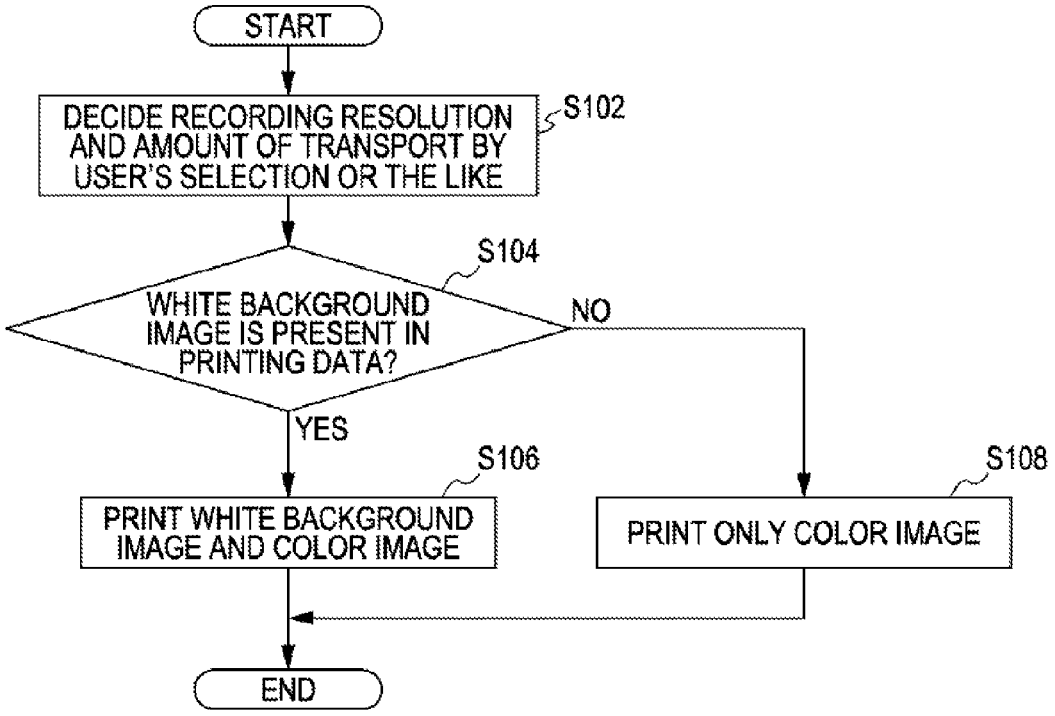
FIG. 7 is a flowchart illustrating a plurality of printing modes in the first embodiment.

FIG. 7 is a flowchart illustrating a plurality of printing modes in a first embodiment. The printing device according to this embodiment has a first printing mode where a background image is formed by the use of white ink and a color image is formed thereon, and a second printing mode where only a color image is formed on the medium.

First, when a printing is requested, printing conditions are input via the printer driver. Thereby, a recording resolution and the amount of medium transported are decided based on the input printing conditions (S102). In addition, printing data is generated based on the decided conditions. The printing data includes data concerning which nozzle is used to form a dot in a pixel. The printer 1 can perform the printing based on the printing data. When the printing data is generated, printing data for printing a white background image is also generated along with printing data for printing a color image. In addition, the printing data for printing a color image may use the same data as the case of printing the white background image and the case of not printing the white background image.

It is determined whether or not the white background image is present in the printing data based on the printing conditions input via the printer driver (S104). Whether or not the white background image is present may be determined via the printer driver by whether a used printing medium is a transparent film sheet or a typical white paper. At this time, for example, when the printing medium is a transparent film sheet, the white background image is determined to be present, and when the printing medium is a typical white paper, the white background image is determined not to be present.

When the white background image is determined to be present, the printer 1 uses printing data for the white background image and printing data for the color image, and prints the white background and the color image (S106). On the other hand, when the white background image is determined not to be present, the printer 1 does not use the printing data for the white background image but uses only the printing data for the color image, to print only the color image (S108). The printing is performed in this way.

Figure 8:
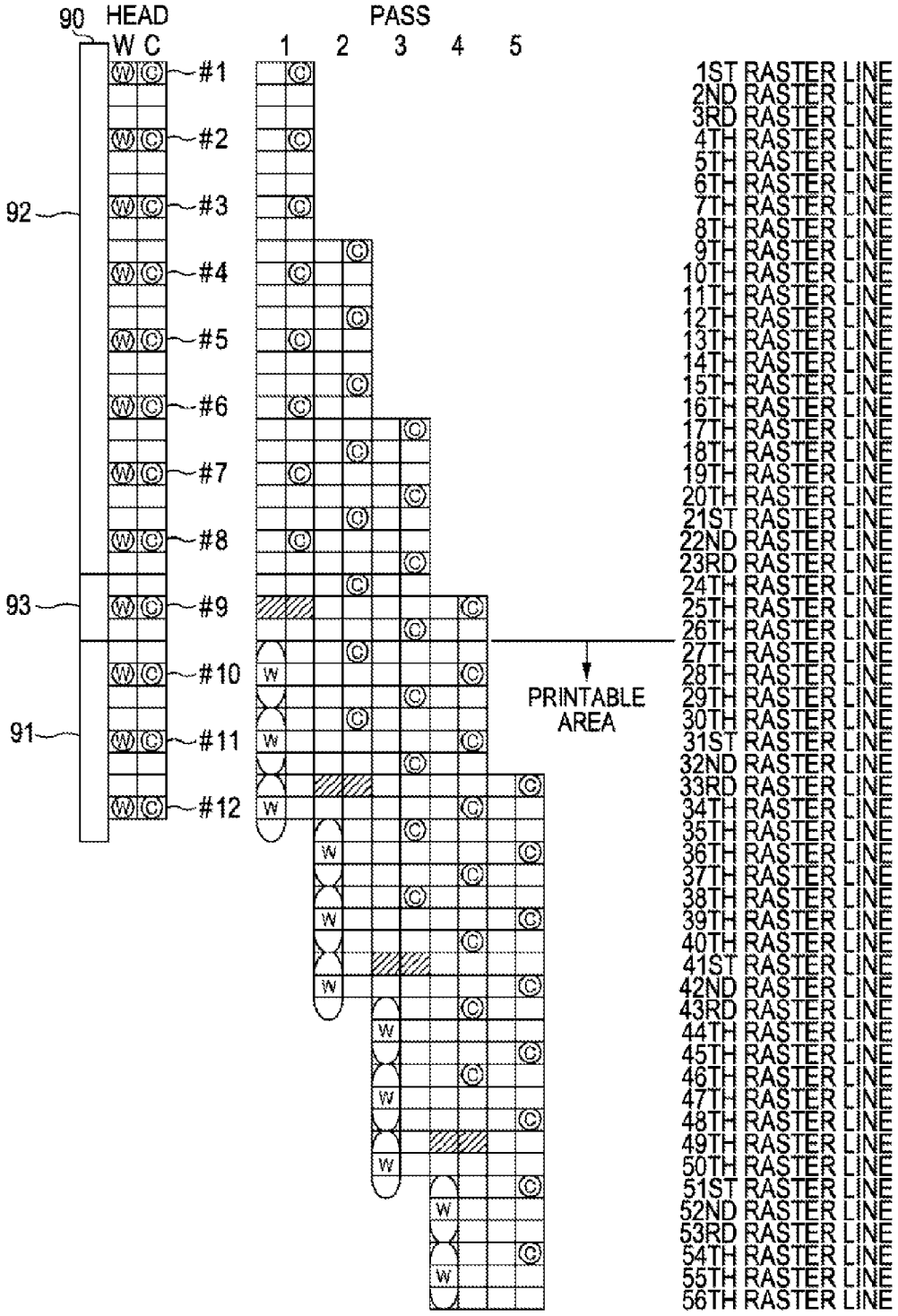
FIG. 8 is a diagram illustrating a printing operation in the first printing mode in the first embodiment.

FIG. 8 is a diagram illustrating a printing operation in the first printing mode in the first embodiment. In the figure, there are shown the ultraviolet radiation unit 90 along with the head including the white ink nozzle line W and the color ink nozzle line C. Here, as the color ink nozzle line C, there may be a plurality of nozzle lines, such as the yellow ink nozzle line Y, the magenta ink nozzle line M, the cyan ink nozzle line Cy, and the black ink nozzle line K; however, for convenience of the description, the description will be made assuming that there is a color ink nozzle line of a single color.

Each nozzle line includes twelve nozzles which are indicated by the nozzle numbers #1 to #12. The nozzles #1 to #8 in the color ink nozzle line are set to eject color ink and the nozzles #9 to #12 are set not to eject the color ink. In addition, the nozzles #1 to #9 in the white ink nozzle line are set not to eject white ink, and the nozzles #10 to #12 are set to eject the white ink. Therefore, the nozzle #9 in the white ink nozzle line and the nozzle #9 in the color ink nozzle line do not eject ink. In other words, these nozzles correspond to nozzles of a nozzle unused area. Furthermore, places corresponding to the unused area are hatched in the raster lines in the respective passes.

In the figure, the printing can be performed from the 27th raster line. Here, an order of forming dots will be principally described based on the 27th raster line to the 34th raster line. In the pass 1, the white ink is ejected on the 28th raster line on the film sheet S by the nozzle #10 in the white ink nozzle line W. At this time, the amount of the white ink W ejected is about nine times greater than the amount of the color ink C ejected described later, and a wet and broadened area by the white ink is about nine times greater than that by the color ink. For this reason, three raster lines are wet and broadened in the sub-scanning direction. As a result, the white ink W ejected on the 28th raster line fills pixels from the 27th raster line to the 29th raster line on the film sheet S.

Also, in the pass 1, the white ink W is ejected on the 31st raster line and the 34th raster line on the film sheet S by the nozzles #11 and #12 in the white ink nozzle line W. At this time as well, the amount of the white ink W ejected is an amount corresponding to a degree where other raster lines are wet and broadened, and as a result, fills pixels from the 30th raster line to the 35th raster line.

In the pass 1, the ink can be ejected by the nozzles #1 to #8 in the color ink nozzle line C; however, herein, the ink is not ejected on the raster lines of interest.

FIG. 8 shows an area of the dots which are wet and broadened by the white ink W in the sub-scanning direction on the sheet, and in fact, the dots may be wet and broadened in a main scanning direction in the same manner.

Next, the film sheet S is transported in the sub-scanning direction. The film sheet S is transported in an amount of eight raster lines.

Also, in the pass 2 after the transport, the white ink W is ejected by the nozzles #10 to #12 in the white ink nozzle line W, but the ink does not land on the raster lines of interest. On the other hand, in the pass 2, the color ink is ejected from the nozzles #1 to #8 in the color ink nozzle line C. Dots by the color ink are formed on the 27th raster line and the 30th raster line by the nozzles #7 and #8 in the color ink nozzle line C. Thereafter, the film sheet S is transported in an amount of eight raster lines.

In the pass 3, the ink from the nozzles in the white ink nozzle line W does not land on the raster lines of interest. On the other hand, in the pass 3, the color ink is ejected on the 29th raster line by the nozzle #5 in the color ink nozzle line C to form a dot, and the color ink is ejected on the 32nd raster line by the nozzle #6 to form a dot. Thereafter, the film sheet S is transported in an amount of eight raster lines.

In the pass 4, the ink from the nozzles in the white ink nozzle line W does not land on the raster lines of interest. On the other hand, in the pass 4, a dot of the color ink is formed on the 28th raster line by the nozzle #2 in the color ink nozzle line C, a dot of the color ink is formed on the 31st raster line by the nozzle #3, and a dot of the color ink is formed on the 34th raster line by the nozzle #4. Thereafter, the film sheet S is transported in an amount of eight raster lines.

In the pass 5, the ink from the nozzles in the white ink nozzle line W does not land on the raster lines of interest. On the other hand, in the pass 5, a dot of the color ink is formed on the 33rd raster line by the nozzle #1 in the color ink nozzle line C.

In this way, so-called band printing is performed for the white ink, and interlacing printing is performed for the color ink. In addition, the printing operation in the second printing mode in the first embodiment is the same as the first printing mode except that the white ink is not ejected.

The ultraviolet radiation unit 90 in this embodiment is divided into a first ultraviolet radiation unit 91, a second ultraviolet radiation unit 92, and a third ultraviolet radiation unit 93. The first ultraviolet radiation unit 91 includes LEDs which are disposed at almost the same positions as the nozzles for ejecting the white ink in the sub-scanning direction in each pass, and the second ultraviolet radiation unit 92 includes LEDs which are disposed at almost the same positions as the nozzles for ejecting the color ink in the sub-scanning direction in each pass. The third ultraviolet radiation unit 93 includes LEDs which are disposed at almost the same positions as the nozzles in either of the nozzle lines which eject no ink in the sub-scanning direction. The first ultraviolet radiation unit 91, the second ultraviolet radiation unit 92, and the third ultraviolet radiation unit 93 have LED radiation intensities which are different from each other.

In detail, the first ultraviolet radiation unit 91 cures the white ink and has an illumination intensity of 1.0 $mW/cm^2$. The second ultraviolet radiation unit 92 cures the color ink and has an illumination intensity of 0.5 $mW/cm^2$. As such, the illumination intensity of the first ultraviolet radiation unit 91 for curing the white ink is set to be higher than that of the second ultraviolet radiation unit 92 for the curing the color ink. In this way, it is possible to cure the white ink immediately after the background is formed on the sheet by the white ink, and to further suppress a color mixing of the white ink and the color ink subsequently landing on the white ink. The third ultraviolet radiation unit 93 is set not to radiate ultraviolet rays so as to save the power consumption.

In order to describe advantages when the printing is performed by forming the nozzle unused area, the following two indices are provided.

First index: the smallest number of passes until the color is recorded in the same pixel after the white is recorded therein.

Second index: the smallest number of passes until the color is recorded in adjacent pixels after the white is recorded in a certain pixel.

These indices indicate the number of passes until the color ink lands after the white ink lands, and thus the index having a greater value is preferable since the white ink is further dried before the color ink lands.

In addition, when the band printing is performed for the white ink as described above, dots of the white ink are formed to be greater than dots of the color ink. Therefore, the color dot is formed on the white dot even in the adjacent raster lines, and this has influence on color mixing. Thereby, the second index is provided.

According to the indices of the above-described condition, the first index is 3 and the second index is 1 in the above-described first embodiment.

A comparative example which is compared with each index in the first embodiment will be described.

Figure 9:
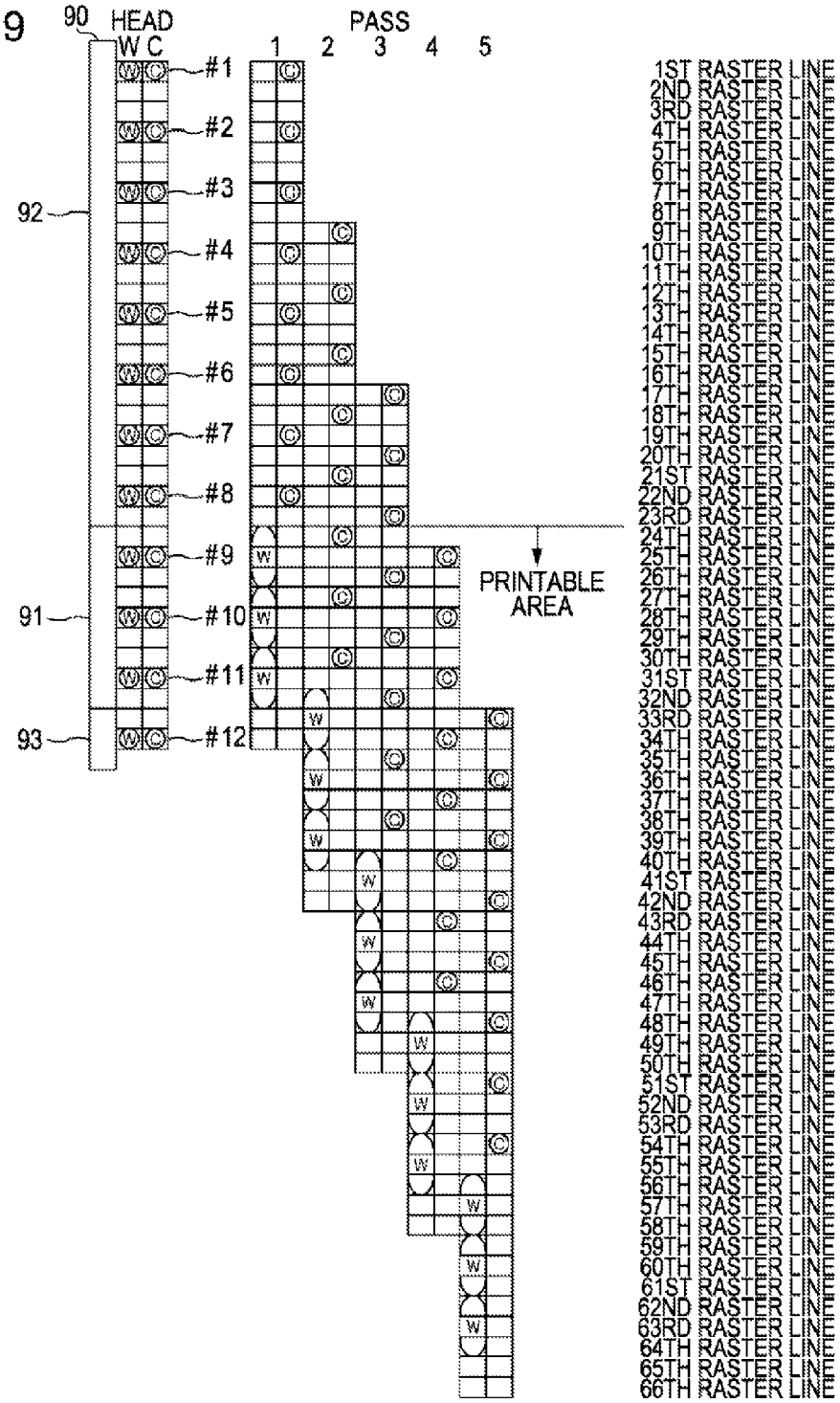
FIG. 9 is a diagram illustrating a printing operation according to a comparative example.

FIG. 9 is a diagram illustrating a printing operation in a comparative example. In each nozzle line in the comparative example, the nozzles #1 to #8 in the color ink nozzle line C are set to eject the color ink, and the nozzles #9 to #12 are set not to eject the color ink. In addition, the nozzles #1 to #8 in the white ink nozzle line W are set not to eject the white ink, and the nozzles #9 to #11 are set to eject the white ink. Among the nozzles in the comparative example, the nozzles #12 in the color ink nozzle line C and the white ink nozzle line W are set not to eject ink.

Under such conditions, FIG. 9 shows a relative position with respect to each raster line of the nozzle lines when the band printing is performed for the white ink and the interlacing printing is performed for the color ink, like the first embodiment. Also, herein, the film sheet S is transported in an amount of eight raster lines, which is the same as the first embodiment.

In the comparative example, the first index is 3 and the second index is 1. When such indices are compared with those in the first embodiment, the index values are the same as each other. However, if only the nozzle #12 is paid attention to, it can be seen that the second index in the first embodiment is 2 which is greater than that in the comparative example, and thus there is partial superiority.

In other words, in the same manner as the first embodiment, there is disposition of the nozzle unused area where no nozzles are used between an area where the nozzles are used in the color ink nozzle line and an area where the nozzles in the white ink nozzle line are used, and thereby it partially takes more time until the color ink lands after the white ink lands. When it takes more time until the color ink lands after the white ink lands, the white ink is further cured or dried at an interval before the color ink lands, and thus it is possible to prevent the white ink and the color ink from mixing with each other.

Figure 10:
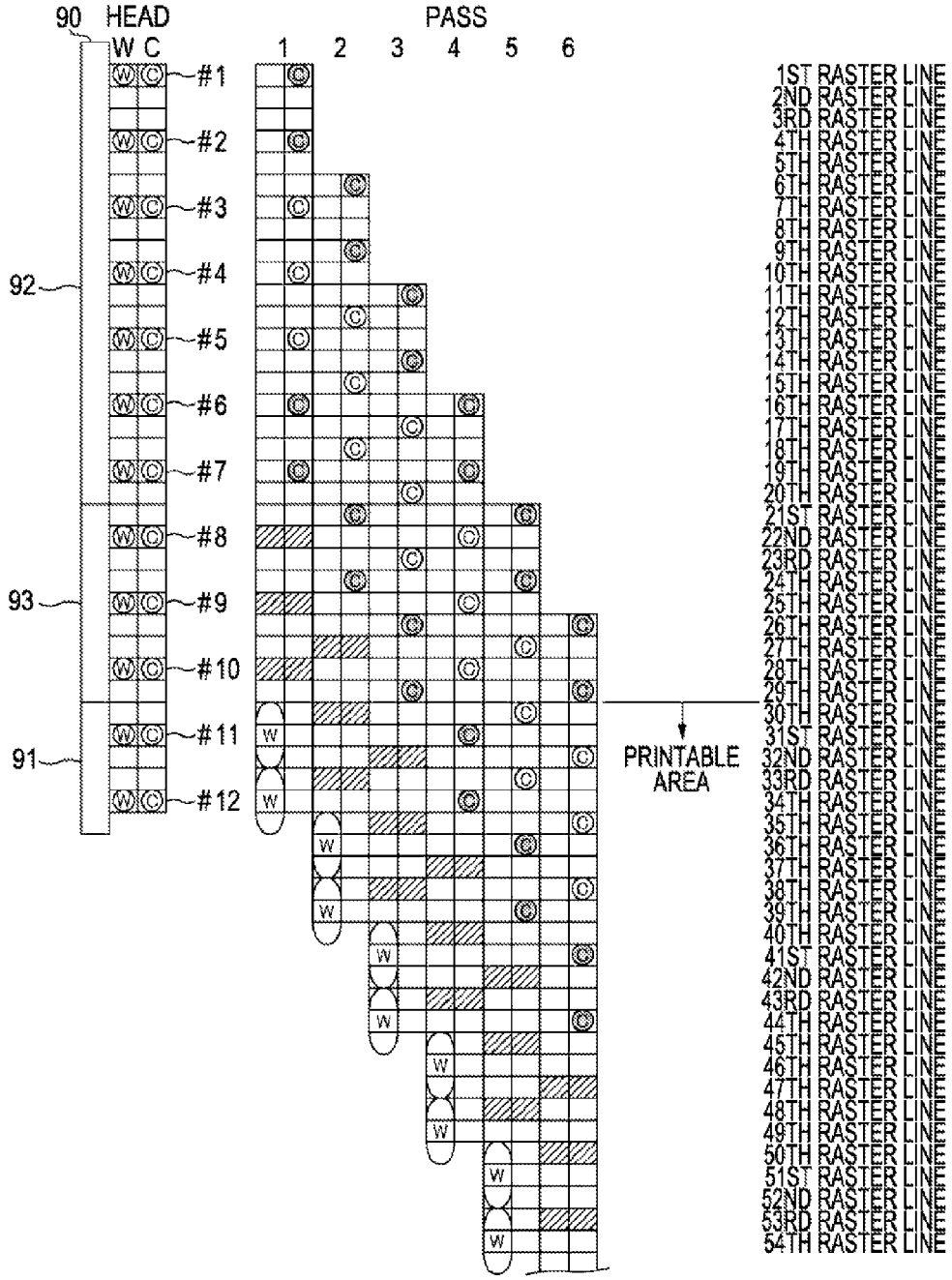
FIG. 10 is a diagram illustrating a printing operation in a first printing mode in a second embodiment.

FIG. 10 is a diagram illustrating a printing operation in a first printing mode in a second embodiment. In each nozzle line in the second embodiment, the nozzles #1 to #7 in the color ink nozzle line C are set to eject the color ink, and the nozzles #8 to #12 are set not to eject the color ink. In addition, the nozzles #1 to #10 in the white ink nozzle line W are set not to eject the white ink, and the nozzles #11 to #12 are set to eject the white ink. In other words, among the nozzles in the second embodiment, the nozzles #8 to #10 in the color ink nozzle line C and the white ink nozzle line W correspond to nozzles of a nozzle unused area. Herein, places corresponding to the nozzle unused area are also hatched in the raster lines in the respective passes.

The first index is 3 and the second index is 2 at this time. In other words, in the second embodiment, the second index is greater than that in the comparative example, and thus it is possible to further suppress the color mixing of the white ink and the color ink, as compared to the comparative example.

Figure 11:
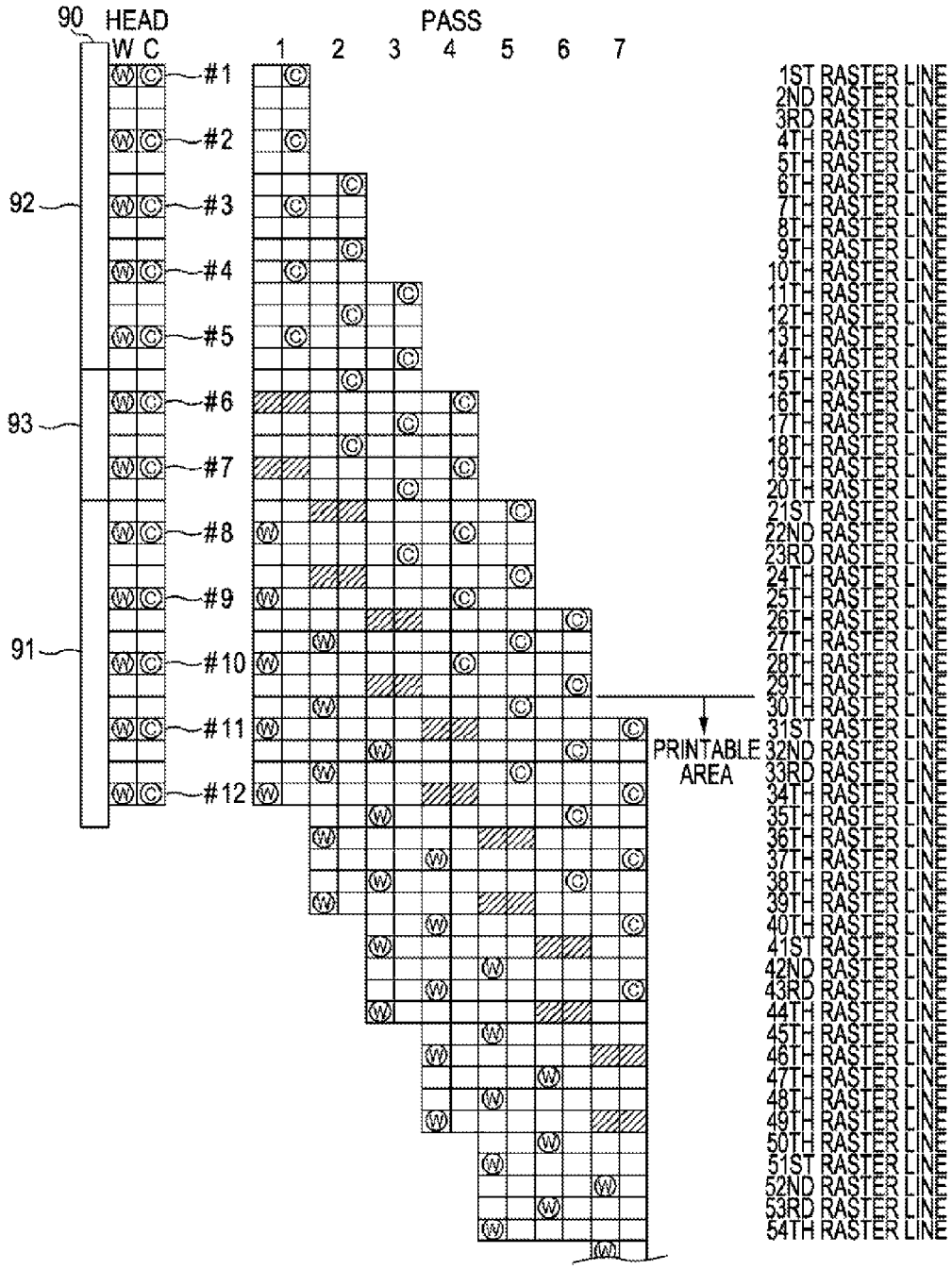
FIG. 11 is a diagram illustrating a printing operation in a first printing mode in a third embodiment.

FIG. 11 is a diagram illustrating a printing operation in a first printing mode in a third embodiment. In the third embodiment, the nozzles #6 and #7 in the color ink nozzle line C and the white ink nozzle line W correspond to nozzles of a nozzle unused area.

The first index is 3 and the second index is 2 at this time. In other words, in the third embodiment as well, the second index is greater than that in the comparative example, and thus it is possible to further suppress the color mixing of the white ink and the color ink, as compared to the comparative example.

Figure 12:
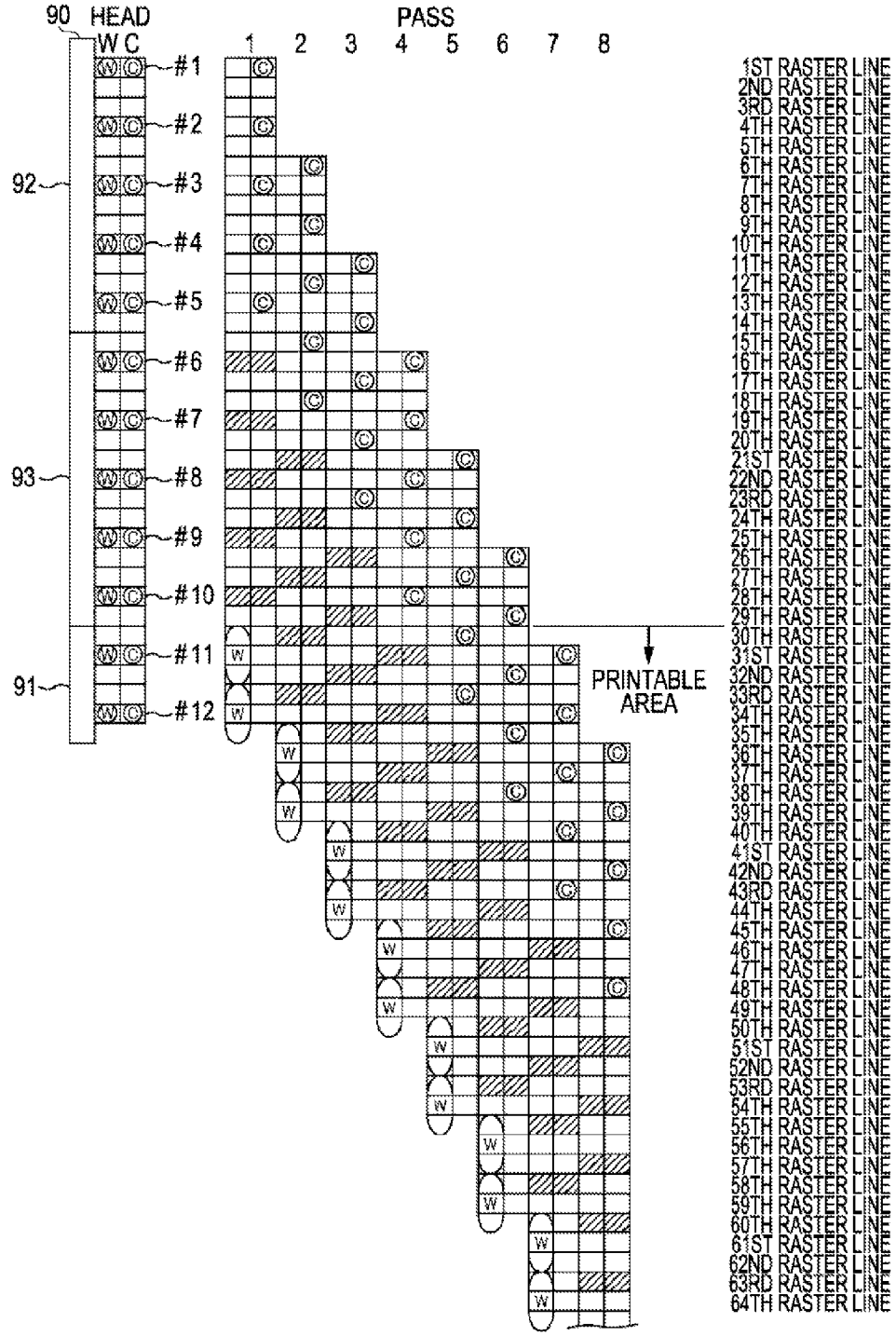
FIG. 12 is a diagram illustrating a printing operation in a first printing mode in a fourth embodiment.

FIG. 12 is a diagram illustrating a printing operation in a first printing mode in a fourth embodiment. In the fourth embodiment, the nozzles #6 to #10 in the color ink nozzle line C and the white ink nozzle line W correspond to nozzles of a nozzle unused area.

The first index is 6 and the second index is 4 at this time. In other words, in the fourth embodiment, the first index and the second index are greater than those in the comparative example, and thus it is possible to further suppress the color mixing of the white ink and the color ink, as compared to the comparative example.

Other Embodiments

In the above-described embodiments, although the printer 1 has been described as a liquid ejecting device, it is not limited thereto, but the embodiments may be implemented by liquid ejecting devices which eject or eject any fluids other than the ink (liquid, liquid body containing dispersed functional particles, or flowing body such as gel). For example, the techniques the same as the above-described embodiments may be applied to various kinds of devices which employ ink eject techniques, such as a color filter fabrication device, a dyeing device, a micro fabrication device, a semiconductor fabrication device, a surface processing device, a three dimensional modeling device, a gas evaporation device, an organic EL fabrication device (particularly, polymer EL fabrication device), a display fabrication device, a film formation device, a DNA chip fabrication device, or the like. Also, the methods or fabrication methods thereof belong to application ranges.

The embodiments are for better understanding of the invention and are not to be construed as limiting the invention. The invention may be modified and changed without departing from the scope thereof and moreover as a matter of course includes the equivalents thereof.

The Number of Nozzles

In the respective embodiments in FIG. 8 and thereafter described above, although the nozzle lines with a small number of nozzles have been described, they may have a large number of nozzles as shown in FIG. 3. In this case, for example, the sub-scanning amount may be greater than that in FIG. 8 for the nozzle lines with a number of nozzles more than that in FIG. 8 (that is, the number of raster lines corresponding to the sub-scanning amount is more than that in FIG. 8).

Sub-Scanning

Although the sub-scanning is performed by transporting the medium in the sub-scanning direction relative to the head in the above-described respective embodiments, the sub-scanning may be performed by moving the head in the sub-scanning direction relative to the medium. In other words, the sub-scanning may be performed by relatively transporting the medium and moving the head in the sub-scanning direction with respect to each other. When the medium is relatively transported with respect to the head, it includes both types.

Dot Formation of Background Image

In the above-described respective embodiments, for example, in FIG. 8, the white nozzle #10 as an example, in the pass 1, may form dots in all the pixels belonging to the 28th raster line, or may not form dots in a part of pixels belonging to the 28th raster line. The background image may have a sufficient light-blocking characteristic, and a part of pixels belonging to raster lines is not necessarily formed with dots. Even when a part of pixels belonging to the 28th raster line are not formed with dots, the band area, which includes the 28th raster line in the pass 1, taking up a predetermined width is filled with dots.

Surfacing Mode and Backing Mode

In the above-described embodiments, although the embodiments have been described in a surfacing mode where the white background is printed on the film sheet and then the color image is printed thereon, embodiments may be also performed in a backing mode where the white background is printed on the color image. In the case of the embodiment in the backing mode, it can be implemented by changing the white ink nozzle line and the color ink nozzle line with each other.

Ink

The white ink W has been exemplified as ink for the background image, but the ink for the background image is not limited to the white ink W.

Head

In the above-described embodiments, the ink is ejected using the piezoelectric element. However, the method of ejecting liquid is not limited thereto. For example, other methods may be used, such as a method or the like of generating foams in the nozzle by the use of heat.

What is claimed is:

1. A printing device which forms a first image using a first ink and forms a second image on the first image using a second ink, comprising:

first nozzles that are capable of ejecting the first ink;

second nozzles that are capable of ejecting the second ink; and a controller that performs an image forming operation that moves the first nozzles and the second nozzles in an inward path or outward path of a main scanning direction, and on a medium forms a first dot of the first ink and a second dot of the second ink;

wherein the controller performs the image forming operation to control moving the first nozzles and the second nozzles in the main scanning direction without forming either of the first dot by a part of the first nozzles or the second dot by a part of the second nozzles due to the presence of one or more unused nozzles that do not eject ink, such moving occurring during a period extending from a time after the first dot is formed using the first ink on the medium to a time before the second dot is formed on at least a portion of the first dot; and wherein in one image forming operation, a number of used first nozzles that eject the first ink differs from a number of used second nozzles that eject the second ink.

2. The printing device according to claim 1, wherein, the controller performs the image forming operation more than twice, without forming either the first dot or the second dot, to at least one of the first dot, before forming the second dot to at least one of the first dot after forming the first dot to the medium.

3. The printing device according to claim 1, further comprising a radiation device configured to radiate light for promoting curing of the first ink and the second ink in the medium, wherein a radiation intensity of the radiation device to the first dot differ from the radiation intensity to the second dot.

4. The printing device according to claim 1, wherein the second dot is formed smaller than the first dot.

5. The printing device according to claim 1, wherein a resolution of the first image is lower than a resolution of the second image.

6. The printing device according to claim 1, wherein in one image forming operation, the number of used second nozzles is larger than the number of used first nozzles.

7. A printing method which forms a first image by a first ink and forms an second image to the first image by a second ink, comprising:

ejecting the first ink from first nozzles;

ejecting the second ink from second nozzles;

performing an image forming operation that moves the first nozzles and the second nozzles in an inward path or outward path of a main scanning direction, and forms a first dot in the first ink and a second dot in the second ink on a medium;

wherein the image forming operation performs the movement of the first nozzle and the second nozzle in the main scanning direction without forming either of the first dot by a part of the first nozzles or the second dot by a part of the second nozzles due to the presence of one or more unused nozzles that do not eject ink, such moving occurring during a period extending from a time after the first dot is formed using the first ink on the medium to a time before the second dot is formed on at least a portion of the first dot; and wherein in one image forming operation, a number of used first nozzles that eject the first ink differs from a number of used second nozzles that eject the second ink.

* * * * *